United States Patent [19]

Noll et al.

[11] Patent Number: 4,537,347

[45] Date of Patent: Aug. 27, 1985

[54] BI-DIRECTIONAL AIR DIFFUSER

[76] Inventors: Robert W. Noll; Brian J. Noll, both of 800 Wikiup Rd., Santa Rosa, Calif. 95401

[21] Appl. No.: 585,336

[22] Filed: Mar. 1, 1984

[51] Int. Cl.[3] ..... F24F 7/00

[52] U.S. Cl. ..... 236/49; 98/40.25

[58] Field of Search ..... 98/40 VT, 40 D; 236/49

[56] References Cited

U.S. PATENT DOCUMENTS 2,057,494 10/1936 Leigh ..... 98/40 VT 4,326,452 4/1982 Nawa et al. ..... 98/40 VT

*Primary Examiner*—William E. Wayner

*Assistant Examiner*—John M. Sollecito

*Attorney, Agent, or Firm*—Townsend and Townsend

[57] ABSTRACT

A linear air diffuser is provided with one discharge opening regulated by a single, longitudinally pivotable blade and a thermally powered, self-contained control mechanism to preferentially orient the blade in response to changes in supply air and/or room air temperature. The diffuser maintains room air temperature at a desired level by varying the size of the discharge opening of the diffuser, thereby effecting a change in the volume of the supply air delivered to the room. In addition, the discharge opening and blade are designed so the cool supply air is discharged horizontally along the ceiling, and warm supply air is discharged vertically downward into the room.

12 Claims, 8 Drawing Figures

BI-DIRECTIONAL AIR DIFFUSER

FIELD OF THE INVENTION

This invention relates generally to heating, ventilation and air conditioning systems, and more specifically to control devices and discharge outlet design for room air diffusers.

BACKGROUND OF THE INVENTION

Linear air diffusers and vents are well known. The simplest of these have fixed outlets directing the flow of the supplied air. However, it is often desirable to be able to preferentially direct discharge of the supply air, depending upon whether the room is to be cooled or heated. For example, for the efficient cooling of a warm room, it is desirable to direct the discharge of the cool supply air horizontally along the ceiling at a relatively high volume. This sets up a broad circulation pattern and maintains the entrainment and air diffusion characteristics necessary to cool the room, while avoiding the unpleasant drafts that would result from merely "blowing" cold air at the room occupants.

On the other hand, for the efficient heating of a cool room, it is often desirable to direct the discharge of the warm supply air vertically downward, at a velocity sufficient to produce a warm air flow at or near the floor level. This minimizes the problem of warm air stratification, and effectively forces the heat into the occupied space. Unfortunately, achieving the necessary air velocity to overcome the warm air stratification is complicated by the fact that many heating systems deliver a reduced volume of warm air (as compared to the volume of cool air delivered in the air conditioning mode).

Some modern linear air diffusers include a control mechanism to accomplish some of these objectives, but most of these require electrical wiring, pneumatic piping or increased system pressure to power the mechanism, thereby limiting their application.

SUMMARY OF THE INVENTION

A linear air diffuser is provided with one discharge opening reguated by a single, longitudinally pivotable blade and a thermally powered, self-contained control mechanism to preferentially orient the blade in response to changes in supply air and/or room air temperature. The diffuser maintains room air temperature at a desired level by varying the size of the discharge opening of the diffuser, thereby effecting a change in the volume of the supply air delivered to the room. In addition, the discharge opening and blade are designed so cool supply air is discharged horizontally along the ceiling, and warm supply air is discharged vertically downward into the room.

DETAILED DESCRIPTION OF A PREFERRED EMBODIMENT

Figure 1:
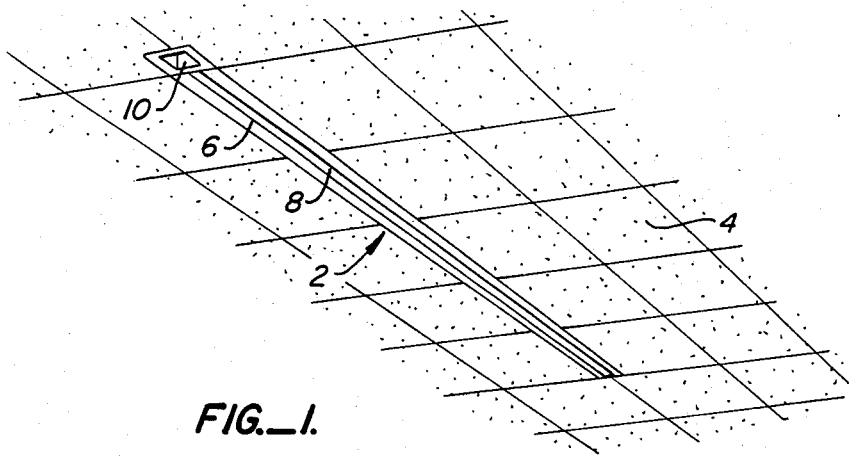
FIG. 1 is a bottom perspective view of a typical linear air diffuser as it might be installed in a ceiling.

Referring now to FIG. 1 with greater particularity, a linear air diffuser 2 is shown as installed in a ceiling 4. In this view, diffuser discharge opening 6, blade 8 and induction trough 10 are all that can be seen of the unit.

Figure 2:
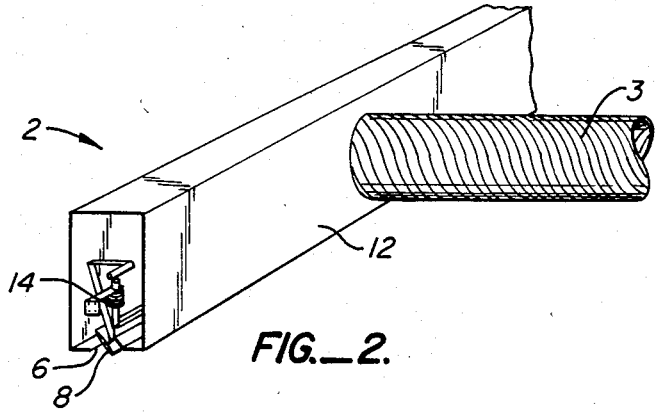
FIG. 2 is a perspective view of a linear air diffuser, plenum and inlet duct work.

FIG. 2 illustrates a typical connection between linear air diffuser 2 and supply air duct 3. Plenum 12 forms the cavity through which the supply air is delivered to discharge opening 6. Control mechanism 14 adjusts the orientation of blade 8 and, accordingly, the direction and volume of air flow.

Figure 3A:
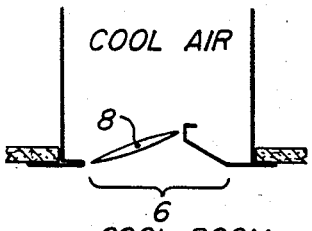
FIGS. 3*a*–3*c* are a series of cross-sectional views of the discharge opening and blade of the linear air diffuser of this invention, illustrating the response and effect of different supply air/room air temperature configurations on the blade orientation.
Figure 3B:
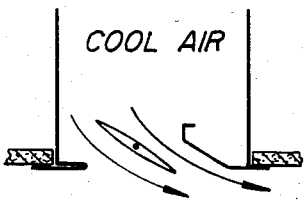
Figure 3C:
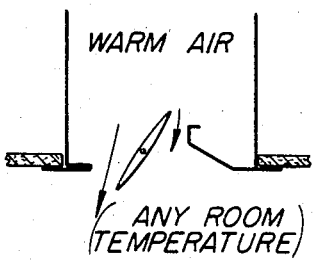

Referring now to FIGS. 3*a* through 3*c* with greater particularity, cross-sectional views of the discharge opening and blade of the linear air diffuser of this invention are shown, illustrating the response and effect of different supply air/room air temperature configurations on the blade orientation. As will be discussed hereinafter, by proper selection and adjustment of the control mechanism and its associated linkage, the blade can be preferentially oriented in response to changes in the ambient air temperature.

FIG. 3*a* illustrates the orientation of blade 8 across discharge opening 6 in a "full closed" position, so that no supply air will be introduced into the room. Such a configuration would be desirable, for instance, in a cool supply air/cool room air situation, when no further cooling is desired.

FIG. 3*b* illustrates the blade orientation that can be achieved with a cool supply air/warm room air situation. In such an environment, blade 8 directs the flow of supply air nearly horizontally next to the ceiling surface. This sets up a broad circulation pattern of cooling air within the room, rather than blowing the cool air directly at room occupants.

FIG. 3*c* shows the system in a warm supply air environment, irrespective of the room air temperature. In this situation, blade 8 is oriented to direct the warm supply air vertically downward into the room itself. Such an orientation minimizes the tendency of the warm air to stratify at ceiling level. Furthermore, because of the asymmetrical design of the discharge opening resulting from the shape of edges 13 and 15, when the blade is in this orientation, the effective size of the maximum discharge opening in this warm supply air mode is less than the size of the opening in the cool supply air mode (FIG. 3*b*). This reduction in discharge opening size serves to increase the velocity of the warm supply air discharged, helping to offset the reduced volume of warm air delivered by some heating systems.

Having generally discussed the various blade orientations within the discharge opening, and the resulting discharge of supply air, the various control mechanisms that have been invented to accomplish these configurations will now be discussed.

Figure 4:
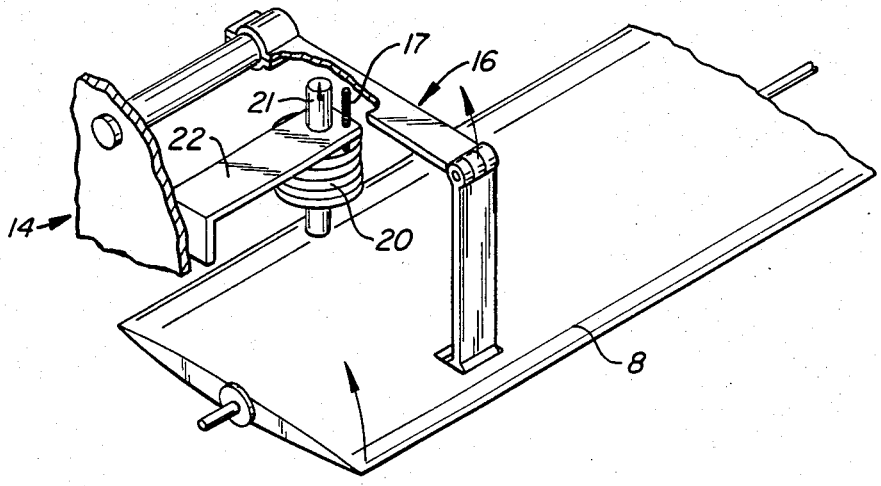
FIG. 4 is a perspective view of the control mechanism and blade of a supply air temperature sensitive linear air diffuser.

Referring now to FIG. 4 with greater particularity, a perspective view of a supply air temperature sensitive linear air diffuser is shown. Control mechanism 14 includes thermostatic actuator 20 which directs its extendible shaft 21 upwards against arm 16 in response to an increase in supply air temperature. Arm 16 is hingedly connected to blade 8, and accordingly, serves to move blade 8, expanding the discharge opening and allowing warm supply air into the room. As was seen in FIG. 3*c*, upon opening the warm air is directed essentially vertically downward into the room. Under these conditions, the maximum size of the discharge opening can be selected by adjustment of thermostatic actuator 20 within its support 22.

When cool air is being supplied, the control mechanism is rendered inoperative. Shaft 21 is retracted into thermostatic actuator 20, and arm 16 moves down to a position determined by set screw 17. By proper adjustment of this set screw, the optimum discharge opening for the cooling mode (FIG. 3*b*) can be selected.

Figure 5:
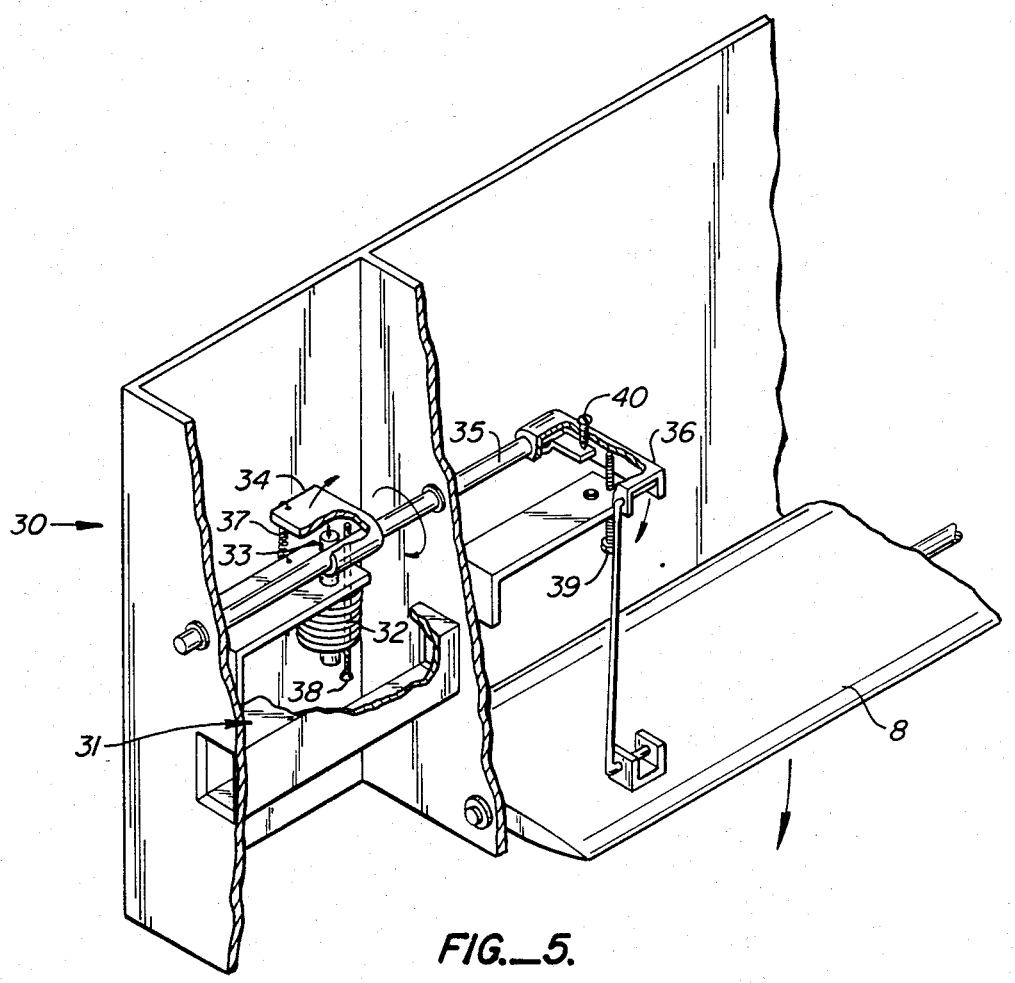
FIG. 5 is a perspective view of the control mechanism and blade of a room air temperature sensitive linear air diffuser.

Referring now to FIG. 5 with greater particularity, a perspective view of a room air temperature sensitive control mechanism 30 is shown. This embodiment reacts only to changes in room air temperature, and modulates from the configuration illustrated in FIG. 3*a* to that illustrated in FIG. 3*b* when the room temperature increases, and from the configuration in FIG. 3*b* back to that in FIG. 3*a* when the room temperature decreases. Thus, this embodiment performs a cooling function only.

Induction channel 31 provides a circulation path for room air across room air thermostatic actuator 32. This element responds to an increase in room air temperature by extending its shaft 33 against arm 34, which acts to rotate axle 35 in the direction indicated by the arrows. The movement of axle 35 serves to move blade 8 via linkage 36, allowing cool air into the room. When the room is cooled, actuator 32 senses this reduction in temperature and retracts its shaft 33. Return spring 37 returns the linkage and blade towards their original position, thus closing the discharge opening.

In this embodiment, the full closed (no discharge) position is adjustable by rotation of set screw 38, and the full open (maximum discharge) position is adjustable with set screw 39. Overload bracket 40 prevents any further effect of the actuator on the blade when the desired maximum position is reached. As before, the thermostatic actuator itself is adjustable by moving it in or out within its support.

Figure 6:
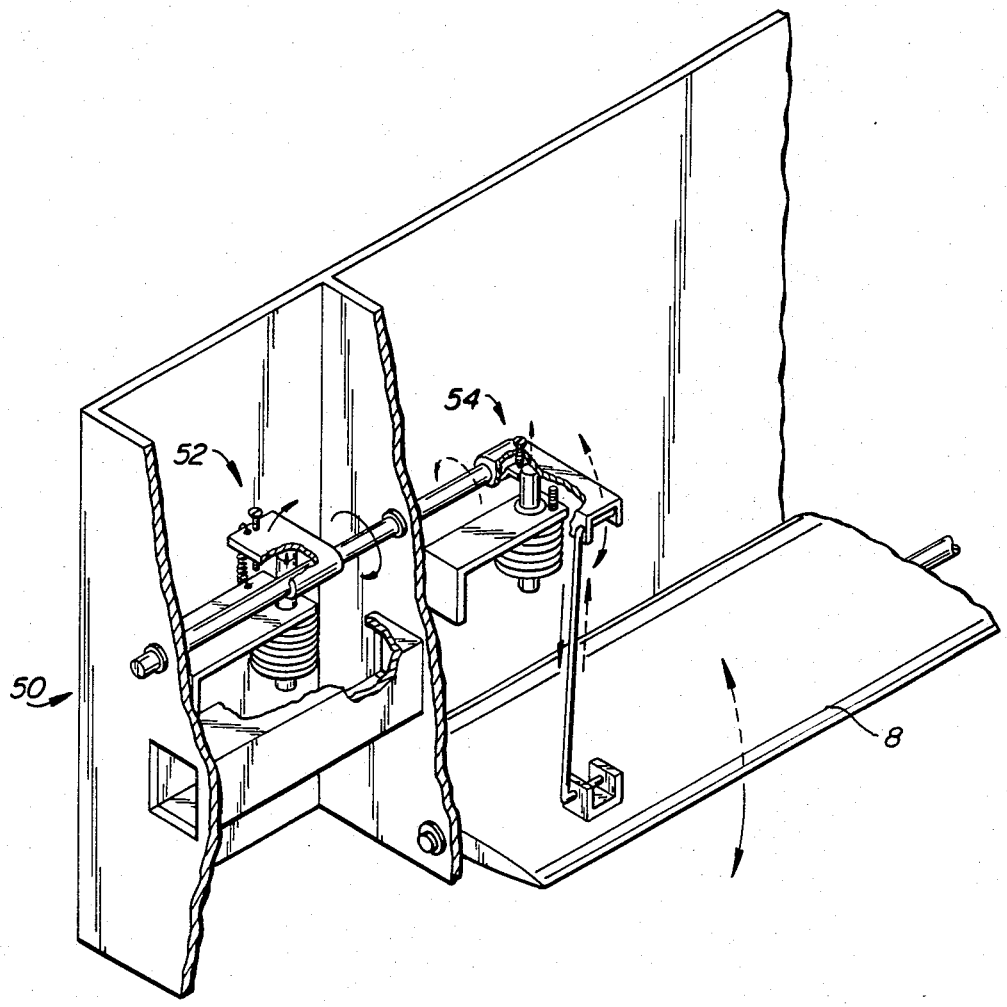
FIG. 6 is a perspective view of the control mechanism and blade of a combination supply air/room air temperature sensitive linear air diffuser.

Referring now to FIG. 6 with greater particularity, a perspective view of a combination supply air/room air temperature sensitive linear air diffuser 50 is shown. Here, the mechanics of the room air element portion 52 are identical to that of room air temperature sensitive control mechanism 30 (FIG. 5), and the mechanics of the supply air element portion 54 are identical to that of the supply air temperature sensitive control mechanism 14 (FIG. 4).

The effect of this combination is to enable the blade position to be a function of the room air temperature when cool air is supplied, and a function of the supply air temperature when warm air is supplied.

While this invention has been described in connection with preferred embodiments thereof, it is obvious that modifications and changes therein may be made by those skilled in the art to which it pertains without departing from the spirit and scope of this invention, as defined by the claims appended hereto.

What is claimed as invention is:

1. A bi-directional ceiling mounted air diffuser for discharging supply air into a room comprising:

output means for varying the orientation and size of an air diffuser discharge opening;

means for sensing the temperature of the supply air;

linkage operatively connecting said supply air temperature sensing means to said output means so that when said supply air temperature is cool, said linkage operates to open said output means and direct said supply air generally parallel to the ceiling of said room, and when said supply air temperature is warm, said linkage operates to open said output means and direct said supply air generally vertically downward into said room, where said output means varies the size of said discharge opening so that the size of said discharge opening is smaller for warm supply air than for cool supply, thereby increasing the discharge velocity of a volume of warm supply air over the discharge velocity of a like volume of cool supply air.

2. The bi-directional air diffuser of claim 1 wherein said output means comprises a single, longitudinally pivotable blade extending the length of said discharge opening.

3. The bi-directional air diffuser of claim 2 wherein said supply air temperature sensing means comprises a thermostatic actuator adapted to extend a shaft in response to an increase in ambient temperature.

4. The bi-directional air diffuser of claim 3 wherein said linkage comprises an axle connected to said blade and conditioned to pivot said blade in response to the movement of said thermostatic actuator shaft.

5. The bi-directional air diffuser of claim 1 wherein said outlet means includes means for increasing the discharge velocity of the warm supply air discharged.

6. The bi-directional air diffuser of claim 5 wherein said means for increasing the discharge velocity comprises an asymmetrical discharge opening.

7. A bi-directional ceiling mounted air diffuser for discharging supply air into a room comprising:

output means for varying the orientation and size of an air diffuser discharge opening;

means for sensing the temperature of the room air; p1 means for sensing the temperature of the supply air;

linkage operatively connecting said room air temperature sensing means and said supply air temperature sensing means to said output means so that when said supply air temperature and said room air temperature are each cool, said linkage operates to close said output means;

when said supply air temperature is cool and said room air temperature is warm, said linkage operates to open said output means and direct said supply air generally parallel to the ceiling of said room; and when said supply air temperature is warm, said linkage operates to open said output means and direct said supply air generally vertically downward into said room.

8. The bi-directional air diffuser of claim 7 wherein said output means comprises a single, longitudinally pivotable blade extending the length of said discharge opening.

9. The bi-directional air diffuser of claim 8 wherein said room air temperature sensing means and said supply air temperature sensing means each comprise a thermostatic actuator adapted to extend a shaft in response to an increase in ambient temperature.

10. The bi-directional air diffuser of claim 9 wherein said linkage comprises an axle connected to said blade and conditioned to pivot said blade in response to the movement of said thermostatic actuator shafts.

11. The bi-directional air diffuser of claim 10 wherein said outlet means includes means for increasing the discharge velocity of the warm supply air discharged.

12. The bi-directional air diffuser of claim 11 wherein said means for increasing the discharge velocity comprises an asymmetrical discharge opening.

* * * * *